United States Patent [19]

Torta

[11] Patent Number: 4,771,498

[45] Date of Patent: Sep. 20, 1988

[54] ROTARY CLEANING BRUSH DEVICE FOR CLEANERS OF PAVED SURFACE

[75] Inventor: Nello Torta, Felegara di Medesano, Italy

[73] Assignee: Idroplina S.R.L., Sanguinaro di Fontanellato, Italy

[21] Appl. No.: 53,335

[22] Filed: May 22, 1987

[30] Foreign Application Priority Data

Jul. 31, 1986 [IT] Italy ..... 22694/86[U]

[51] Int. Cl.[4] ..... A47L 11/00

[52] U.S. Cl. ..... 15/49 R; 15/87; 15/180

[58] Field of Search ..... 51/177; 15/180, 49 R, 15/50 R, 87, 98, 230.16

[56] References Cited

U.S. PATENT DOCUMENTS

| | | | |
|---|---|---|---|
| 2,088,650 | 8/1937 | Hartley | 15/98 |
| 3,082,451 | 3/1963 | Smithson | 15/49 R |
| 3,409,379 | 11/1968 | Vanderveer | 15/49 R |

FOREIGN PATENT DOCUMENTS

| | | | |
|---|---|---|---|
| 467873 | 4/1914 | France | 15/50 R |
| 399675 | 3/1966 | Switzerland | 15/49 R |

*Primary Examiner*—Harvey C. Hornsby
*Assistant Examiner*—J. Dwight Poffenberger, Jr.
*Attorney, Agent, or Firm*—Browdy and Neimark

[57] ABSTRACT

The invention relates to a rotary cleaning brush device for cleaners of paved surfaces, whose brushes (2) are aligned perpendicularly to the straight travel direction of the cleaner and have peripheral regions which are formed of an orderly succession of projections (8) and recesses (9), the projections (8) of each brush (2) fitting into the recesses (9) of another brush (2), and having at least one pair of brushes (2) arranged with their respective axes of rotation (4) convergent together in a direction away from a surface (7) to be swept, the brushes (2) being rotated in a direction which produces, in the areas of least mutual distance between the brushes (2), tangent velocities which are on the average oppositely directed with respect to the straight travel direction of such cleaners.

1 Claim, 1 Drawing Sheet

Fig. 2
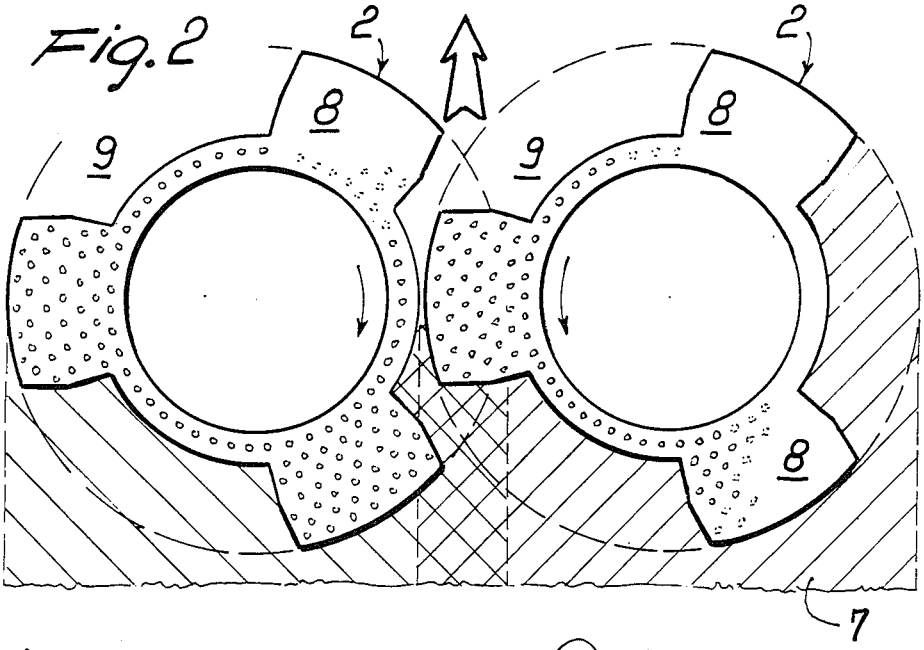
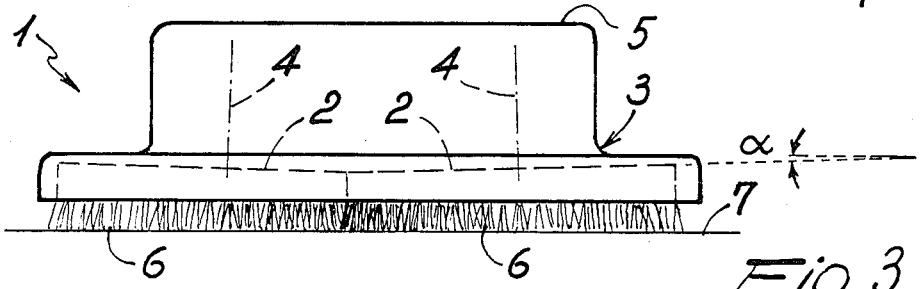
Fig. 3
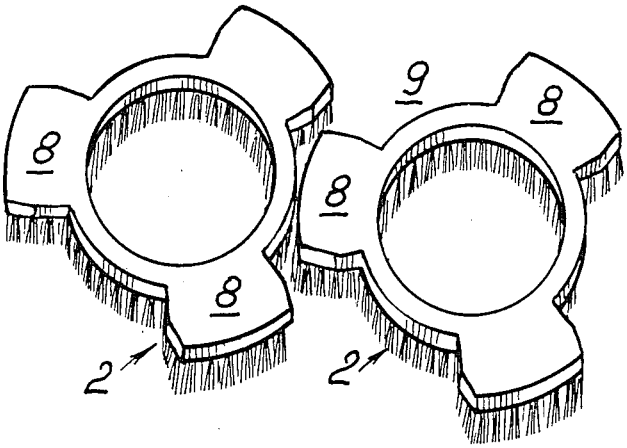
Fig. 1

ROTARY CLEANING BRUSH DEVICE FOR CLEANERS OF PAVED SURFACE

BACKGROUND OF THE INVENTION

This invention relates to a rotary cleaning brush device for cleaners of paved surfaces.

As is known, machines and equipment for cleaning floors and the like surfaces have long been available on the market. Such machines range from very simple designs to comparatively sophisticated designs for professional applications. In each case, they include devices having two or more cleaning brushes which are set for rotation close together to perform at least a substantial proportion of the cleaning operation.

Many cleaners have, for example, a brush head comprising two circular brushes mounted side-by-side for counter-rotation. The two brushes are close to each other but, of course, not tangent, and a sufficiently wide gap is left therebetween to avoid any interference and assembly problems.

The two brushes of such brush heads are aligned in a transverse direction but not in a perpendicular direction to the straight direction of advance of the heads, which would be coincident with the longitudinal centerline of such machines.

It has been found, in fact, that if the two brushes are aligned perpendicularly to the straight direction of advance, during the forward movement of the brush head in a straight line there is formed an unswept continuous thin stripe on a paved surface at the linear gap between the brushes.

In order to overcome this drawback, the two brushes are set obliquely to said longitudinal centerline. Thus, each brush is caused to act over an area which partly overlaps that of the other brush, thereby avoiding formation of an unswept stripe.

That arrangement has the disadvantage that it confers an irregular outline on the cleaner, increases the machine length dimension, and makes cleaning close against a wall, or in any case along the edges of floors, more difficult.

In fact, the cited brush head stands in many instances proud of such cleaners, on which it usually forms the foremost portion, and is to take an oblique attitude much like that of the brushes themselves. In this condition, it is the very forward working end of the machine which becomes asymmetrical relatively to the machine main extension.

These problems have led to the manufacture and sale of other cleaners provided with a brush head having three brushes, wherein two brushes are laid along a perpendicular direction to the machine longitudinal centerline and the third brush extends in an intermediate, either forward or rearward, set position, so as to form a triangular set of brushes.

It may be appreciated that the approach just described has good operational features, but involves a more complex and expensive construction than that using two brushes only and is significantly bulky. In general, this approach only becomes viable with cleaners of higher price and size.

SUMMARY OF THE INVENTION

In the light of the above-outlined situation, the technical aim which underlies this invention is to provide a rotary brush device which can substantially obviate the cited drawbacks.

Within the above technical aim, it is an important object of this invention to provide a device which affords optimum cleaning operation conditions even with just two side-by-side brushes.

Another object of the invention is to provide a device which is particularly useful with cleaners having no arrangements for self-propulsion.

A not least object of the invention is to provide a device which is simple and may be incorporated to a variety of cleaners and sweeping equipment.

This technical aim, and the objects set forth above, are substantially achieved by a rotary brush device for cleaners of paved surfaces, characterized in that said brushes have peripheral regions formed with an orderly succession of projections and recesses and are laid side-by-side such that said projections of each said brush fit at least partway into said recesses of another such brush, the side-by-side brushes in each pair being driven rotatively in opposite directions.

BRIEF DESCRIPTION OF THE DRAWINGS

Further features and the advantages of this invention will become apparent from the following description of the rotary brush device shown in the accompanying drawings, where:

FIG. 1 shows schematically in perspective two brushes of the inventive device isolated from the remainder;

FIG. 2 is a plan view of the brushes of FIG. 1 showing their action on a surface; and FIG. 3 shows the brushes of FIG. 1 as fitted to the brush holder head of a floor washer.

DESCRIPTION OF THE PREFERRED EMBODIMENTS OF THE INVENTION

With reference to the drawing figures, the device of this invention is comprehensively designated 1.

It comprises two side-by-side brushes 2 which are shown in FIG. 3 as assembled to a brush holder head 3, e.g. of the kind of those used on cleaners commonly referred to as "auto-scrubbers". These machines have relatively compact dimensions and are for washing and drying the floor areas of sheds, warehouses, commercial establishments, and more generally large area paved surfaces. The brush holder head 3 is located, on these machines, at the forward end of the machines.

The brushes 2 are rotatable about axes 4 and driven rotatively by specially provided drive members 5 such that they can act on a surface 7 with respective working sides 6.

As shown in FIGS. 1 and 2, the brushes 2 have, across perpendicular planes or sections to the axes 4, peripheral regions formed with an orderly succession of projections 8 and recesses 9.

Provision is made for the brushes 2 interleaving with each other, thereby the projections 8 fit into the recesses 9, and for same to turn in opposite directions of rotation at concurrent tangent velocities in the area of mutual interleave. In the instance shown, angular velocities would be the same because the brushes are identical to each other.

In the embodiment shown, the brushes have three tooth-like projections 8 and three wide recesses 9. The recesses 9 have a larger width than the projections 8 to provide ample clearance between the brushes and no interference and assembly problems. Furthermore, the projections 8 are caused to fit with a major portion thereof into the recesses 9, thereby ensuring in all cases loose fit interpenetration even with low-precision constructions.

The brushes 2 are laid side-by-side and aligned perpendicularly to the straight direction of advance envisaged for the device 1, as shown in FIG. 2.

A further important feature of the inventive device 1 is the following.

The axes 4 are arranged to converge together in a direction away from the surface 7 so as to bring the working sides 6 closer to the surface 7 in the area of interpenetration of the brushes. Furthermore, the directions of rotation of the brushes are selected to have, in that same area of interpenetration, oppositely directed tangent velocities with respect to the envisaged straight direction of advance of the device.

The planes of lay of each brush, perpendicular to the axes 4, are contemplated to be slanted by an angle alpha of at least one degree over the surface 7. The magnitude of the angle alpha should be selected each time according to the type of brush being used and its pliability so as to achieve substantially maximum inclination of the brushes compatibly with even and homogeneous cleaning throughout the surface 7.

The device 1 operates as follows:

As shown in FIG. 2, the brushes 2, being aligned perpendicularly to the straight travel direction of the device 1, will interleave with each other and act on lanes across the surface 7 which are not separated by unswept stripes. Indeed, the lanes would partly overlap each other.

The slanted setting of the brushes 2 by the angle alpha also results in increased frictional engagement of the working sides 6 with the surface 7 in the very area of partial overlap. This increased friction reflects in a reaction thrust being applied to the brushes 2 in the opposite direction to the directions of their tangent velocities in that same area.

It follows that the brushes will exert a significant traction or propulsive force along the straight direction of advance of the device, thereby greatly facilitating the action of an operator where the cleaner or apparatus equipped with these brushes happens to have no self-propelling features. Otherwise, these brushes would serve to minimize the power requirements of any self-propulsion provisions.

What may be even more important is that these brushes exert a stabilizing effect on the machine by tending to keep truly on a straight line or to straighten it up when negotiating bends. Thus, the machine operator has a valuable steering aid afforded to him/her because the machine travel path can be straightened nearly automatically and is made significantly more stable in its straight-line travel.

Different embodiments of the invention from the one discussed hereinabove are possible, such as incorporating more than two brushes. In the latter instance, a set of brushes, all laid side-by-side and interacting, may be arranged without increasing, contrarywise to the prior art, the longitudinal dimension of the machine mounting them and to greatly expand the overall area being swept.

Where more than two brushes are provided, any brush pair would be driven in opposite directions of rotation. Accordingly, with three interacting brushes, the middle brush would turn in an opposite direction to the side brushes.

In order to secure the aforesaid tractive and straightening effect it is expedient that an even number of brushes be used, or that the third brush be set true flat.

The invention affords important advantages.

In fact, this device is quite simple and readily adapted for fitting to a cleaner. The brushes are of minimal bulk in lengthwise of the machine mounting them, owing to their being aligned perpendicularly to the machine longitudinal centerline, and yet the areas swept by the individual brushes overlap to ensure thorough cleaning.

In addition, the brushes can provide accurate traction or propulsive force in the straight direction of travel to partly make the use of a propulsion motor unnecessary, especially with small size cleaners. It should be noted that if this traction feature were incorporated to prior design devices having their brushes aligned obliquely to the machine, the resulting thrust would be also directed obliquely and, accordingly, detrimental more than beneficial to the machine steering performance.

I claim:

1. A cleaner of paved surfaces, said cleaner including propulsion means for propelling said cleaner along a linear path of travel, said propulsion means comprising a rotary brush device which also exerts a sweeping action upon a paved surface while propelling said cleaner, said rotary brush device including:

two brushes mounted for rotation in opposite directions, the two brushes having peripheral regions formed with an orderly succession of projections and recesses, and being laid side by side such that said projections of each said brush fit at least partway into said recesses of the other said brush to define an area of partial overlap of said brushes;

said brushes being aligned perpendicularly to the linear path of travel of said cleaner, and said brushes having mutually convergent rotation axes in a direction away from said paved surface, the slanted setting of said axes resulting in two local increased frictional engagements with a paved surface being cleaned, both increased engagements occurring in said area of partial overlap;

the rotation of said brushes in opposite directions producing, in said area of partial overlap of said brushes where both of said local increased frictional engagements are provided, a reaction thrust directed along said linear path of travel.

* * * * *